United States Patent [19]

Ruhstorfer

[11] Patent Number: 4,740,280

[45] Date of Patent: Apr. 26, 1988

[54] ELECTROLYTE FOR ELECTROCHEMICALLY POLISHING METAL SURFACES

[75] Inventor: Friedrich Ruhstorfer, Garching, Fed. Rep. of Germany

[73] Assignee: Poligrat GmbH, Fed. Rep. of Germany

[21] Appl. No.: 64,095

[22] Filed: Jun. 18, 1987

[30] Foreign Application Priority Data

Jun. 20, 1986 [EP] European Pat. Off. ..... 861018474.7

[51] Int. Cl.[4] ..... C25F 3/20

[52] U.S. Cl. ..... 204/129.95

[58] Field of Search ..... 204/129.85, 129.95

[56] References Cited

U.S. PATENT DOCUMENTS 4,626,328 12/1986 Mohr ..... 204/129.95

*Primary Examiner*—T. M. Tufariello

*Attorney, Agent, or Firm*—Woodard, Emhardt, Naughton, Moriarty & McNett

[57] ABSTRACT

The electrolyte according to the invention for electrochemically polishing articles made of steel, stainless steel, nickel alloys, aluminum, and aluminum alloys, and containing phosphoric acid and sulfuric acid comprises an addition of a chelating agent on the basis of phosphonic acids and, if desired, a stabilizer for the latter.

20 Claims, No Drawings

ELECTROLYTE FOR ELECTROCHEMICALLY POLISHING METAL SURFACES

Electrochemical polishing or shining of metal surfaces is applied frequently in the art so as to give surface treatment to smaller or greater articles made of steel, stainless steel, nickel alloys, and aluminum or aluminum alloys. The electrolytes used for this purpose, as a rule, contain phosphoric acid and sulfuric acid, and, if desired, chromic acid, and the workpieces are connected anodically. With this kind of electropolishing, the articles to be given a shine which are suspended from corresponding carrier members or in baskets and the like, are lowered into the electrolyte, i.e. the polishing bath and, after a certain polishing period, are withdrawn from the same. Upon draining of the bath liquid from the polished surfaces, the articles subsequently are dipped into cleaning baths so as to remove the electrolyte.

It is known to use electrolytes on the basis of sulfuric acid/phosphoric acid/chromic acid for electrochemical polishing of aluminum and aluminum alloys. The inhibitory effect of the chromic acid is meant to prevent incipient etching of aluminum in the currentless condition. Yet it has two disadvantages:

(a) During the electrochemical polishing a certain proportion of the chromic acid is reduced to chromium (III) ions with which the electrolyte becomes enriched in the course of time. This affects the polishing from about 2% by weight on of chromium (III) ions.

(b) Chromium (III) ions being discharged together with the rinsing water get into the sewage and require a special stage in waste water treatment to reduce the chromium (III) ions which are highly toxic to the less toxic chromium (II) ions.

For this reason attempts were made to work with an electrolyte free of chromic acid. This, on the other hand, caused the difficulty with the rapid onset of etching on the polished surfaces in currentless state. Any such subsequent etching of polished surfaces is highly undesirable because it turns dull the surface which was shined before. This is not only a question of destroying the once attractive appearance of the shiny surface, it also makes the surface rough so that the respective articles will be less resistent when in use later on. To avoid this effect, quick transfer is needed from the electrolyte into the rinsing bath. This in turn means spilling and therefore wasting electrolyte and consequently requiring great quantities of chemical substances with the corresponding burdening and elevated cost of sewage treatment.

Steel, especially high-grade steel or stainless steel and nickel alloys are polished electrochemically by using electrolytes which contain sulfuric acid/phosphoric acid and, if desired, chromic acid. The gloss obtainable by electrochemical polishing largely depends on the degree of flatness of the surface, and this is improved at increasing polishing periods. Satisfactory results usually are achieved at current densities of approximately 25 $A/dm^2$ in 7 minutes and approximately 10 $A/dm^2$ in about 20 minutes, depending on the composition of the electrolyte.

It is an object of the invention to provide an electrolyte, free of chromic acid, for the electrochemical burr removal and polishing, in other words for the electrolytical or electrochemical removal of metal roughness from the surface of shaped bodies made of aluminum or aluminum alloys, on the one hand, and steel, stainless steel, and nickel alloys, on the other hand. It is another object of the invention to provide an electrolyte which will protect the freshly polished surfaces of aluminum or aluminum alloys against any subsequent etching and dulling before the electrolyte is rinsed off. Yet another object of the invention is to provide an electrolyte which will produce high gloss on surfaces of steel, stainless steel, and nickel alloys.

These objects are met, in accordance with the invention, in that chelating agents on the basis of phosphonic acids, preferably in an amount of from 1 to 100 g/l are added to the electrolyte which contains sulfuric and phosphoric acids.

From 20 to 30 g/l are preferred for the electrolyte intended for aluminum treatment, while from 10 to 20 g/l of phosphonic acid, based on the acid electrolyte, are preferred for treating workpieces consisting of steel or nickel alloys.

It is highly surprising that such an addition of phosphonic acids to the electrolyte has an inhibitory effect on the freshly polished surface, whereby the incipient etching of aluminum workpieces is reduced to a minimum in the currentless state while they are transferred from the electrolyte into the rinsing baths. The electrolyte according to the invention thus makes it possible to lift the articles just polished from the electrolyte, let them drain, and only then lower them into the rinsing bath without running the risk of surface etching or swapping any great quantities of acid into the rinsing bath.

It is just as surprising that the addition of phosphonic acids in accordance with the invention, in electrochemical polishing processes, provides the desired gloss in so much less time than conventional electrolytes when treating articles made of steel, stainless steel, or nickel alloys. Because of this shorter polishing time—savings of about 30% are achieved easily—less metal on the whole is removed so that the electrolyte becomes useful for longer periods of time.

A phosphonic acid which proved to be especially well suited for use according to the invention is morpholino-methane-diphosphonic acid having the general formula:

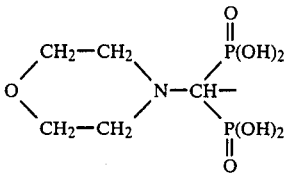

Likewise very suitable are 1-hydroxyethane-1,1-diphosphonic acid, aminotrismethylene phosphonic acid, diethylene triamine pentamethylene phosphonic acid, and hydroxymethyl diphosphonic acid.

In the electrolytic polishing, hydrogen and oxygen are generated by water electrolysis. It is known that these gases are extremely aggressive, especially in statu nascendi. For this reason any additive to the electrolyte must be characterized by extraordinary stability, especially against reduction and oxidation. If minor decomposition should take place anyway, care must be taken in selecting the additives that any such decomposition products are not toxic, especially not cancerogenic. It is particularly in consideration of these requirements, especially as regards stability against nascent oxygen and hydrogen that morpholine-methane-diphosphonic acid is specifically well suited for the electrolyte according to the invention.

The effect of these chelating phosphonic acids when used in the electrolytic polishing or deburring of metal surfaces is extremely surprising because chelating agents have been used in electrolytic baths for electroplating, i.e. in the electrolytic deposition of metal coatings, especially of gold and other precious metals and their alloys on articles which are connected cathodically when it was desired to obtain especially well adhering coatings or metal precipitates.

When polishing aluminum and aluminum alloys, in general, the current density applied is from 5 to 15 A/dm$^2$, preferably from 8 to 10 A/dm$^2$, the polishing time is from 15 to 20 minutes, and the electrolyte temperature some 80° C. In the case of steel and stainless steel the current density should be from 10 to 15 A/dm$^2$, preferably 15 A/dm$^2$ at a temperature of about 50° C., and in the case of nickel alloys corresponding values should be from 5 to 30 A/dm$^2$ at temperatures in the same range and a polishing time of about 15 minutes.

Under extreme working conditions, such as a very high working temperature and the resulting more aggressive nature of the electrolyte, the generally good stability of the phosphonic acids against acid electrolytes may be improved still further by adding stabilizers. Very successful stabilizers proved to be nitrilotriacetic acid, particularly the sodium salt thereof, at a concentration of from 0.5 to 2% by weight, especially approximately 1% by weight, and sodium glucoheptonate at a concentration of from 0.5 to 2% by weight, especially approximately 1% by weight.

The invention will be described further, with reference to the examples below.

EXAMPLE 1

An electrolyte was prepared containing 900 cm$^3$/l phosphoric acid (85% by weight) and 100 cm$^3$/l sulfuric acid (96% by weight) and 25 g/l of morpholinomethane-diphosphonic acid were added to the same for use in the polishing of articles made of aluminum and an aluminum alloy, respectively, at a current density of 9 A/dm$^2$ and 80° C. for a period of 10 minutes. Subsequently the articles were lifted out of the polishing bath; the electrolyte was given time to run down and drip off; and no etching of the surface was discovered after 60 seconds. The articles then were rinsed clean of the acid. The time period may be extended by increasing the amount of phosphonic acid.

On the other hand, if an electrolyte is used without the additive according to the invention, etching begins after no more than 3 seconds.

EXAMPLE 2

10 g/l of morphonlino-methane-diphosphonic acid and 1% by weight of nitrilotriacetic acid are added to an electrolyte which contained 660 cm$^3$/l of phosphoric acid (85% by weight) and 340 cm$^3$/l of sulfuric acid (96% by weight). Stainless steel articles were polished in this electrolyte. Perfect gloss was obtained at a current density of 15 A/dm$^2$ and 50° C. after a polishing period of some 6 to 7 minutes.

It took 10 minutes to obtain the same shine in an electrolyte without the addition of phosphonic acid.

EXAMPLE 3

An elextrolyte for nickel alloys: 600 cm$^3$/l of phosphoric acid (85% by weight), 400 cm$^3$/l of sulfuric acid (96% by weight), 30 g/l of diethylene triamine pentamethylene phosphonic acid—current density 15 A/dm$^2$, polishing time 7 minutes.

If an electrolyte is used which does not contain the additive according to the invention, approximately 10.5 minutes are needed to achieve the same gloss.

What is claimed is:

1. An electrolyte for electrochemically polishing articles made of steel, stainless steel, nickel alloys, aluminum and aluminum alloys, and said electrolyte comprising a bath of phosphoric acid, sulfuric acid, and a chelating agent on the basis of phosphonic acids.

2. The electrolyte as claimed in claim 1, wherein said bath contains from 1 to 100 g/l of chelating agent.

3. The electrolyte as claimed in claim 1, wherein said chelating agent is morpholinomethane-diphosphonic acid.

4. The electrolyte as claimed in claim 2, wherein said chelating agent is morpholinomethane-diphosphonic acid.

5. The electrolyte as claimed in claim 1, wherein said bath additionally contains a stabilizer for said phosphonic acid.

6. The electrolyte as claimed in claim 5, wherein said bath contains from 0.5 to 2% by weight of stabilizer.

7. The electrolyte as claimed in claim 6, wherein said stabilizer includes nitrilotriacetic acid.

8. The electrolyte as claimed in claim 6, wherein said stabilizer includes sodium glucoheptonate.

9. The electrolyte as claimed in claim 5, wherein said stabilizer includes nitrilotriacetic acid.

10. The electrolyte as claimed in claim 5, wherein said stabilizer includes sodium glucoheptonate.

11. The electrolyte as claimed in claim 2, wherein said bath additionally contains a stabilizer for said phosphonic acid.

12. The electrolyte as claimed in claim 11, wherein said bath contains from 0.5 to 2% by weight of stabilizer.

13. The electrolyte as claimed in claim 3, wherein said bath additionally contains a stabilizer for said phosphonic acid.

14. The electrolyte as claimed in claim 13, wherein said bath contains from 0.5 to 2% by weight of stabilizer.

15. The electrolyte as claimed in claim 13, wherein said stabilizer includes nitrilotriacetic acid.

16. The electrolyte as claimed in claim 13, wherein said stabilizer includes sodium glucoheptonate.

17. The electrolyte as claimed in claim 4, wherein said bath additionally contains a stabilizer for said phosphonic acid.

18. The electrolyte as claimed in claim 17, wherein said bath contains from 0.5 to 2% by weight of stabilizer.

19. The electrolyte as claimed in claim 17, wherein said stabilizer includes nitrilotriacetic acid.

20. The electrolyte as claimed in claim 17, wherein said stabilizer includes sodium glucoheptonate.

* * * * *